US009730486B2

(12) United States Patent
Brown et al.

(10) Patent No.: US 9,730,486 B2
(45) Date of Patent: Aug. 15, 2017

(54) SELF-RECOVERING IMPACT ABSORBING FOOTWEAR

(71) Applicants: Christopher Brown, Worcester, MA (US); Nicholas Workman, Worcester, MA (US); Michael Doyle, Worcester, MA (US); Jessica Shelsky, Worcester, MA (US)

(72) Inventors: Christopher Brown, Worcester, MA (US); Nicholas Workman, Worcester, MA (US); Michael Doyle, Worcester, MA (US); Jessica Shelsky, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 521 days.

(21) Appl. No.: 13/860,877

(22) Filed: Apr. 11, 2013

(65) Prior Publication Data

US 2013/0318832 A1 Dec. 5, 2013

Related U.S. Application Data

(60) Provisional application No. 61/623,430, filed on Apr. 12, 2012.

(51) Int. Cl.

| | |
|---|---|
| ***A43B 1/10*** | (2006.01) |
| ***A43B 1/12*** | (2006.01) |
| ***A43B 3/14*** | (2006.01) |
| ***A43B 13/00*** | (2006.01) |
| ***A43B 13/14*** | (2006.01) |
| ***A43B 13/02*** | (2006.01) |

(Continued)

(52) U.S. Cl.
CPC ..... *A43B 13/18* (2013.01); *A43B 13/122* (2013.01); *A43B 13/141* (2013.01); *A43B 13/203* (2013.01); *A43B 13/22* (2013.01)

(58) Field of Classification Search
CPC ..... A43B 13/122; A43B 13/141; A43B 13/48; A43B 13/203
USPC ..... 36/25 R, 11, 4, 7.3, 7.4, 7.1
See application file for complete search history.

(56) References Cited

U.S. PATENT DOCUMENTS 3,251,144 A * 5/1966 Weitzner ..... A43B 3/0078 36/100
3,668,792 A 6/1972 York
(Continued)

*Primary Examiner* — Clinton T Ostrup
*Assistant Examiner* — Cameron A Carter
(74) *Attorney, Agent, or Firm* — Chapin IP Law, LLC

(57) ABSTRACT

An impact absorbing footwear device employs opposed planar sole portions engaged by a selective resistance coupling that biases the opposed planar sole portions in a non-linear manner in response to forces exerted by the wearer against the sole portion in frictional contact with a floor surface. The planar sole portions are disposed in a footwear appliance that takes the form of an athletic shoe sole. The selective resistance coupling includes a plurality of resilient deformation members that engage the planar sole portions in an opposed circumferentially aligned manner, selectively deform in response to pressure exerted by the wearer for preventing ACL and other impact related injuries, and recover to an undeformed rest position without breakaway to allow the wearer uninterrupted usage while dampening forces that surpass an injury threshold from the resilient deformation that allows the planar sole portions to temporarily misalign.

20 Claims, 6 Drawing Sheets

(51) Int. Cl.

| | |
|---|---|
| ***A43B 13/18*** | (2006.01) |
| ***A43B 13/12*** | (2006.01) |
| ***A43B 13/20*** | (2006.01) |
| ***A43B 13/22*** | (2006.01) |

(56) References Cited

U.S. PATENT DOCUMENTS

| | | | | |
|---|---|---|---|---|
| 3,707,047 | A | 12/1972 | Nedwick | |
| 4,546,556 | A | 10/1985 | Stubblefield | |
| 4,651,446 | A * | 3/1987 | Yukawa | A43B 3/00 235/105 |
| 4,670,997 | A | 6/1987 | Beekman | |
| 5,255,453 | A | 10/1993 | Weiss | |
| 5,456,027 | A | 10/1995 | Tecchio | |
| 5,701,685 | A * | 12/1997 | Pezza | A43B 13/18 36/27 |
| 5,867,923 | A | 2/1999 | Lehneis | |
| 5,937,544 | A * | 8/1999 | Russell | A43B 7/1425 36/27 |
| 6,327,795 | B1 * | 12/2001 | Russell | A43B 13/145 36/27 |
| 6,665,958 | B2 * | 12/2003 | Goodwin | A43B 13/12 36/29 |
| 7,254,905 | B2 | 8/2007 | Dennison | |
| 7,334,349 | B2 * | 2/2008 | Sokolowski | A43B 13/125 36/25 R |
| 7,487,606 | B2 * | 2/2009 | Koo et al. | A43B 1/0054 36/141 |
| 7,946,059 | B2 * | 5/2011 | Borel | A43B 13/026 36/28 |
| 8,387,279 | B2 * | 3/2013 | Pauk | A43B 13/12 36/25 R |
| 8,397,402 | B2 * | 3/2013 | Lucas | A43B 3/0042 36/102 |
| 8,776,397 | B2 * | 7/2014 | Borel | A43B 13/026 36/103 |
| 2007/0011919 | A1 * | 1/2007 | Case | A43B 1/0036 36/132 |
| 2007/0240331 | A1 * | 10/2007 | Borel | A43B 13/026 36/28 |
| 2009/0113758 | A1 * | 5/2009 | Nishiwaki | A43B 13/10 36/88 |
| 2009/0235556 | A1 * | 9/2009 | Reid | A43B 3/163 36/7.1 R |
| 2009/0278707 | A1 * | 11/2009 | Biggins | A43B 1/0027 340/870.16 |
| 2009/0284368 | A1 * | 11/2009 | Case, Jr. | A43B 3/0005 340/539.1 |
| 2010/0077638 | A1 * | 4/2010 | Simms | A43B 5/185 36/136 |
| 2012/0042540 | A1 * | 2/2012 | Miner | A43B 1/0027 36/29 |
| 2012/0079747 | A1 * | 4/2012 | Seo | A43B 13/183 36/25 R |

* cited by examiner

SELF-RECOVERING IMPACT ABSORBING FOOTWEAR

RELATED APPLICATIONS

This patent application claims the benefit under 35 U.S.C. §119(e) of U.S. Provisional Patent App. No. 61/623,430, filed Apr. 12, 2012, entitled "SELF-RECOVERING IMPACT ABSORBING FOOTWEAR," incorporated herein by reference in entirety.

BACKGROUND

Anterior cruciate ligament (ACL) tears have kept athletes off of the field for months at a time, occasionally benching players permanently. Repairing a torn ACL requires surgery and extensive physical therapy to regain full range of motion in the knee. Even with these advanced measures, severe arthritis can still develop within the knee. Many of these injuries are caused from non-contact situations where direct contact to the knee never occurs. It has been estimated that approximately 250,000 ACL injuries occur per year and about 70% of these are non-contact situations.

Increased media attention on sports medicine and related orthopedic surgical measures has highlighted the significance of ACL injuries. Further, the professional sports industry is continually spotlighted as a business and revenue generation medium, thus heightening the emphasis on continued player performance. Even college athletics has become a significant investment for top tier schools, who focus substantial resources on facilities, recruiting, and training to maintain a high caliber team. Each of these interests drives the need for the most advanced equipment to ensure continued safe athletic performance.

SUMMARY

An impact absorbing footwear device employs opposed planar sole portions engaged by a selective resistance coupling that biases the opposed planar sole portions in a non-linear manner in response to forces exerted by the wearer against the sole portion in frictional contact with a floor surface. The selective resistance coupling includes a plurality of resilient deformation members that engage the planar sole portions in an opposed circumferentially aligned manner, selectively deform in response to pressure exerted by the wearer for preventing ACL and other impact related injuries, and recover to an undeformed rest position without breakaway to allow the wearer uninterrupted usage while dampening forces that surpass an injury threshold from the resilient deformation that allows the planar sole portions to temporarily misalign. The non-linear response of the selective resistance coupling provides a decreasing resistance once the wearer-exerted force exceeds an injury threshold, while an increased resistance response assures the wearer of responsive traction when the exerted force is below the injury threshold.

Configurations herein are based, in part, on the observation that sports injuries often occur when an athlete's limbs are subjected to an extreme force while engaging in a sport, usually as a result of sudden intense movements resulting from the nature of the sport, such as jumping, turning, landing, falling, and other athletic maneuvers.

Unfortunately, conventional approaches to athletic protection suffer from the shortcoming that accommodation or mitigation of extreme forces typically involves a disengagement of equipment which, although mitigating injurious force, leaves the equipment or appliance in an inoperative or disengaged state, requiring manual intervention to reset the appliance for further use. Such "breakaway" approaches include, for example, ski bindings which detach skis from the boot to prevent harmful leg injuries, yet end the race for the skier.

The proposed approach as claimed herein incorporates multiple directions of force absorption including, but not limited to, shear and normal directions to the ground, which result in reaction forces that contribute to ACL injuries in athletes. Conventional approaches, discussed further below, offer single direction absorption or prevention of forces absorbed but do not include shear and normal ground reaction force absorption in one system. Additionally, the proposed approach includes a recoverable system that will recover quickly enough to be used in the next placement of the foot on the ground after the system has been activated. This is an improvement on conventional approaches including a fail system where components are detached when activated. The recovery system allows for the activation of the force absorbing mechanism without the athlete being able to detect that the system is active. The recovery therefore allows for the player to continue playing without any change in gait of the athlete.

Accordingly, configurations herein substantially overcome the above described shortcoming of breakaway, single use or resettable approaches by providing a footwear appliance with nondestructive force mitigation employing shear and impact control between interface surfaces between a foot of the athlete and the playing surface (floor), that allows force control and mitigation by remaining substantially fixed during normal forces within a control threshold, and selectively displaces upon forces exceeding the control threshold prior to an injury threshold that could prove harmful. Resilient beams moderate movement between the interface surfaces (interfaces), and deflect upon exceeding the control threshold to mitigate harmful forces, then recovering to the non-displaced position to enable continued competition. In particular, ACL injuries, often correlated with sudden twisting leg movements, demonstrate the type of forces the proposed approach mitigates.

In a particular configuration, the apparatus takes the form of footwear appliance for mitigating injurious lateral and vertical forces, and includes a plurality of beams arranged around a perimeter of a lower plane defining a frictional interface to a floor surface, such that the beams extend upward substantially orthogonal to the lower plane. An upper plane is retained by the beams in slidable communication with the lower plane, such that the beams circumferentially surround and engage the upper plane for limiting movement in response to lateral forces between the upper and lower planes. The planes are disposed in a footwear appliance that takes the form of an athletic shoe sole. The lateral forces result from friction with the floor surface and opposing forces from the upper plane, typically in response to movements of the wearer during an athletic event such as basketball or football. The beams are configured to deflect in response to the lateral forces and subsequently return the upper plane to alignment between the undeflected beams in a springlike manner due to the resilient and/or rubbery composition of the lower plane, discussed further below.

The appliance may therefore operate as a frictional interface device including a lower plane defining a frictional interface to a floor surface, corresponding to a shoe sole bottom in a conventional athletic shoe. The lower plane includes one or more beams disposed on a circumference of the lower plane for defining a set of beams extending substantially orthogonal to the lower plane and upwards to surround the upper plane. The upper plane slideably engages the lower plane, such that the upper plane remains aligned with the lower plane for restricted movement based on the beams, in which the upper plane defines an interface to an operator via the athletic shoe. The beams are configured to engage the upper plane and deflect in response to lateral movement of the upper plane relative to the lower plane, and are further adapted to subsequently return the upper plane to alignment with the lower plane in response to the lateral movement, so that the athlete may return to normal movement following a beam deflection for preventing injury. In other words, the lower plane "spring" or "snaps" back to alignment via the resilient construction rather than permanently separating as with conventional breakaway protective appliances. It should be further noted that the beams extending from the lower plane is discussed as an example herein and the beams may extend from either the upper and lower plane for engaging with the opposed plane.

The disclosed configurations therefore employ a method of mitigating forceful movement in an athletic footwear appliance by permitting predetermined displacement of a footwear interface from forces in response to frictional response from a floor surface, and limiting displacement of the footwear interface for forces less than a control threshold, such that limiting results from restricted movement of the footwear interface against a floor interface engaged with the floor surface. The appliance allows displacement exceeding the predetermined displacement in response to forces exceeding the control threshold, for preventing injury, as the control threshold is less than an injury threshold determined to transmit harmful forces to the footwear interface.

BRIEF DESCRIPTION OF THE DRAWINGS

The foregoing and other features will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1A:
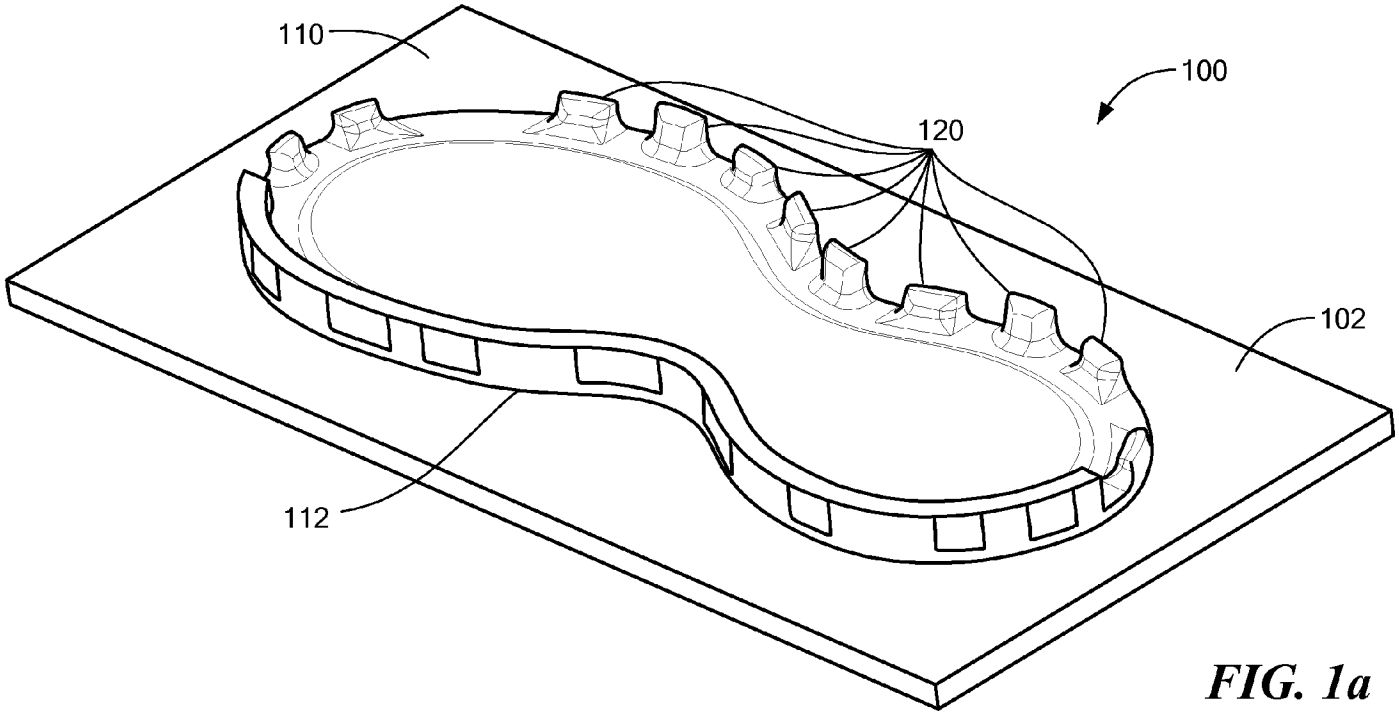
FIG. 1*a* is a perspective view of the beam structure of the device as disclosed herein.

In a particular configuration discussed further below, an injury preventative footwear appliance includes a plurality of resilient members extending from a planar surface and an opposed planar surface engaging the plurality of resilient members, such that the opposed planar surfaces have a substantially similar shape and are disposed in alignment at a rest position by the resilient members. The resilient members are adapted for deformation upon movement of the planar surface relative to the opposed planar surface, such that the resilient members bias the planar surfaces at a rest position and provide a selective resistance to the movement based on a predetermined threshold of force. A recovery linkage maintains engagement of the opposed planar surfaces in response to forces exceeding the injury threshold such that the sole portions do not "breakaway" and separate completely but rather return to the undeformed rest position in a self-recovery manner, likely without the wearer being aware that an injury has been prevented. Thus, the limiter coupling is adapted to return the opposed planar surfaces to the rest position following deformation. In this configuration, therefore, the predetermined threshold is an injury threshold and the opposed planar surfaces are upper and lower sole portions of an athletic shoe prone to sudden forceful movements of an athlete. The selective resistance of the resilient members increases with a force of the movement until an injury threshold of force, and then decreases for force exceeding the injury threshold.

Configurations disclosed herein proposed a redesigned sole of an athletic shoe with a mechanical system to prevent or reduce the occurrence of ACL injuries in athletes. There are three directions of forces which cause ACL tears in athletes; normal to the ground, shear along the x-axis and shear along the y-axis with the x- and y-axis determined to be parallel to the ground. The shear force directions are addressed with a multi-layered system in the sole of the shoe that allows additional motion in the shear directions described. A beam system will then absorb these forces when the system is activated. The system will only be activated when force levels begin to reach injury level. This beam system consists of a series of beams varying in height, allowing the layers to press against the beams absorbing the forces in this direction. Forces normal to the ground are absorbed with a mechanical system that allows additional motion in that direction when activated. In an example configuration as disclosed herein, such absorption is created with an air valve system. The activation of the system creates an airflow that removes air from the system allowing further compression of the shoe to take place. This increase in the distance traveled during injury level forces creates a system that can absorb additional forces; thereby limiting potential injury caused by anterior tibia rotation in the lower leg. The system will only be activated when force levels exceed normal conditions, and are nondestructively and automatically recoverable, and may be deployed multiple times. The design of the fluid air system can also be applied to the shear directions in the x-y plane. Placing an air tube around the shoe in replace of the beam system can mimic the results the beam system can produce.

The multi beam system works by having a set of beams varying in height; some at a short length and some at a taller length. The beams hold the system in place during normal playing conditions. When the load on the beams approaches that which would be dangerous to the athlete, the shearing layer of the system will be forced over the shorter beams. At that point, the taller beams will be in control of the motion shearing layer, allowing more motion in the shear direction but a controlled motion that can mitigate the injurious forces. For adjustability, the shearing layer could be moved up and down relative to the beams, which would alter the forces required to force over the shorter set of beams.

FIG. 1*a* is a perspective view of the beam structure of the device as disclosed herein. Referring to FIG. 1*a*, the beam structure 100 includes a lower plane surface 110 having a plurality of beams 120-S, 120-L (120 generally) disposed around a perimeter 112 in the shape of a footwear appliance. Shorter beams 120-S provide initial resistance, and pass the load onto longer beams (120-L) after a predetermined resistance based on a control threshold. Alternatively, varying lengths of beams may be employed, depending on the tier thresholds of desired response. The beams 120 extend orthogonally from the lower plane 110 and are adapted to slideably engage an upper plane discussed further below, and may be formed from a homogeneous molding 102 or sheet of resilient material from which a footwear shape may be cut. The resilient material may also be employed in conjunction with a spring based mechanism, or replaced entirely by a spring or other mechanism (such as pressure loaded cylinders) for exhibiting compression and tension forces as disclosed herein.

Figure 1B:
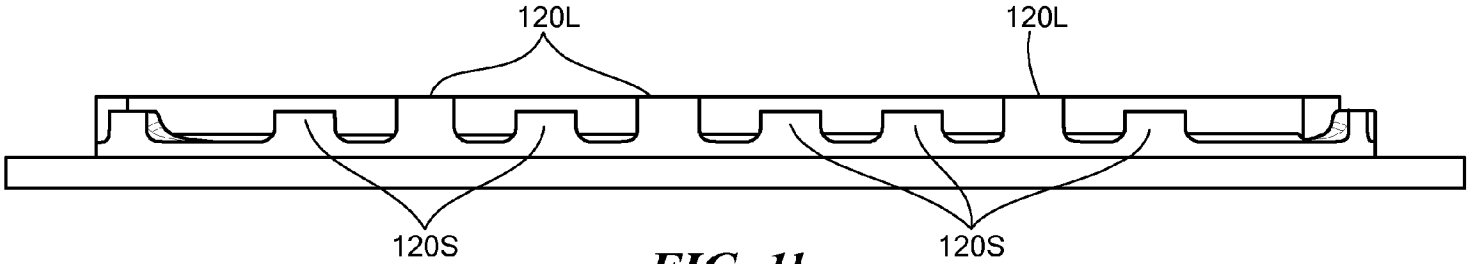
FIG. 1*b* is a side elevation of the beam structure of the device of FIG. 1*a;*
Figure 1C:
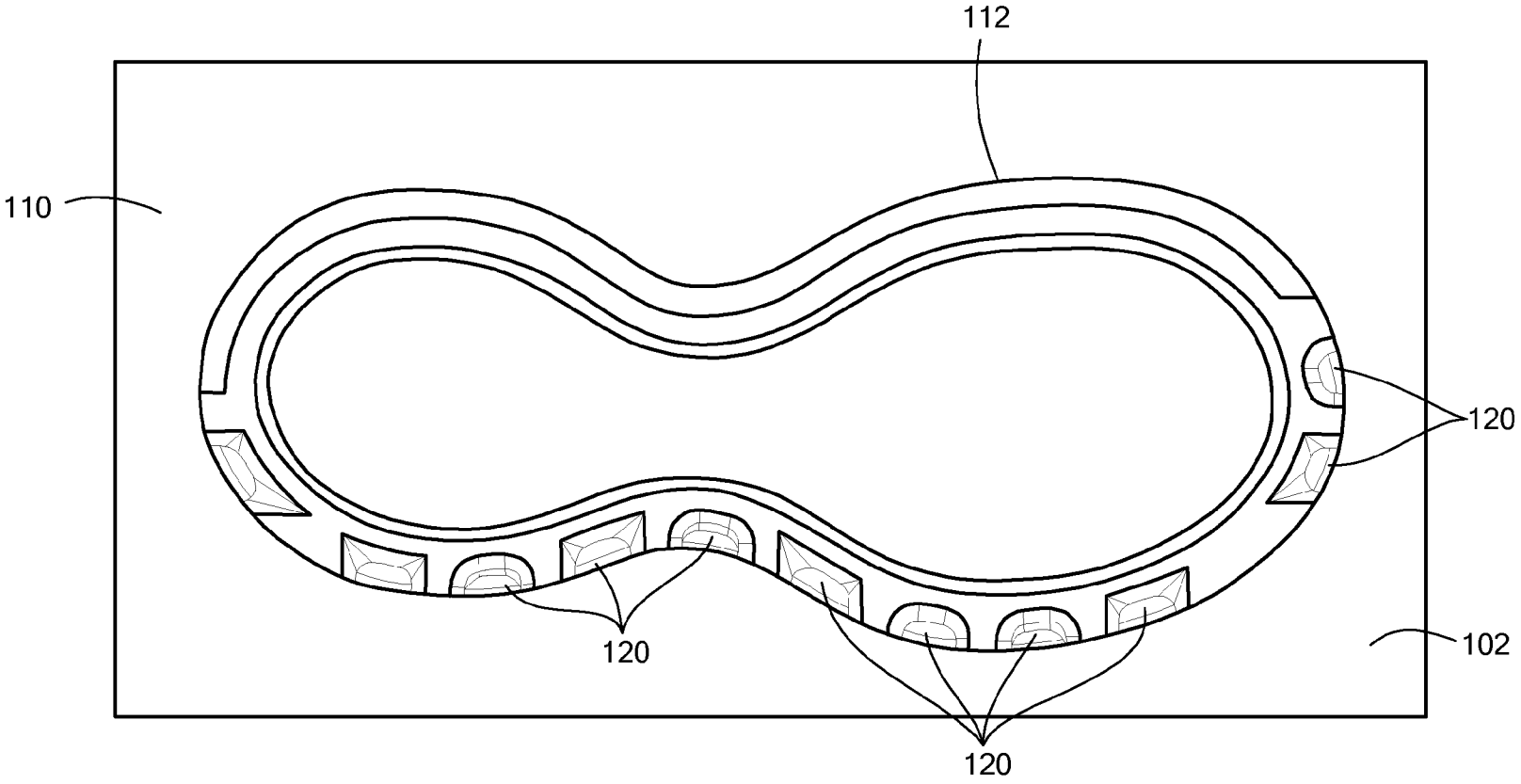
FIG. 1*c* is a plan view of the beam structure of FIG. 1*a;*

FIG. 1*b* is a side elevation of the beam structure 100 of the device of FIG. 1*a*. The beams 120 are formed continuously with the molding 102 to define the lower plane 110, and the beams 120 extend upward to engage the perimeter of the upper plane. FIG. 1*c* is a plan view of the beam structure of FIG. 1*a* showing the perimeter 112 and the beams 120 disposed at various locations around the perimeter, discussed further below.

Figure 2:
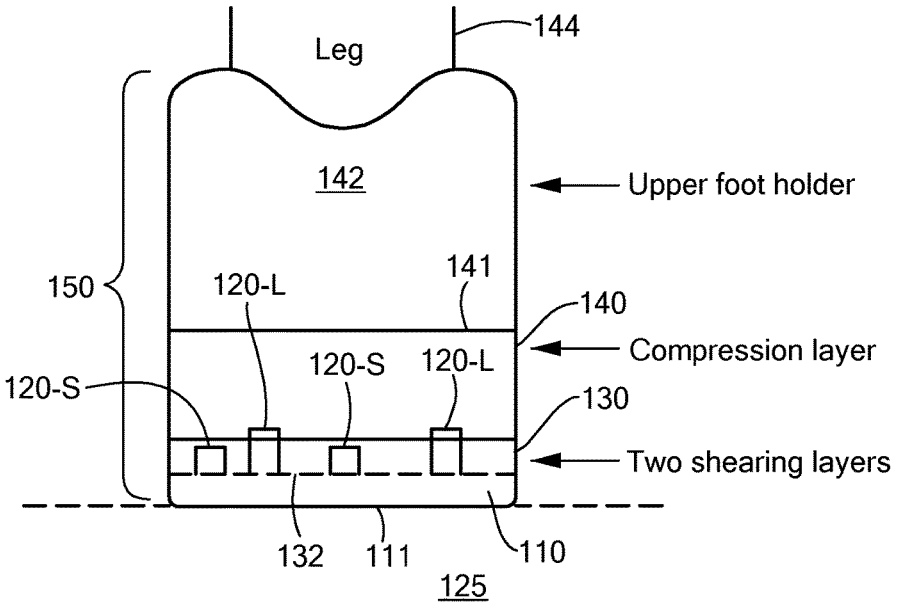
FIG. 2 shows a structure of the device of FIGS. 1*a*-1*c* in a footwear appliance

FIG. 2 shows a structure of the device of FIGS. 1*a*-1*c* in a footwear appliance 150. Referring to FIGS. 1*a*-1*c* and 2, the footwear appliance 150 includes the lower plane 110 having the beams 120 in slidable communication with an upper plane 130, which is maintained substantially aligned with the perimeter of the lower plane 110 while at a rest position, and collectively form two shearing layers adapted to temporarily slide out of alignment for relieving lateral shear forces through a friction relieving layer 132. The beams 120 further include longer beams 120-L and shorter beams 120-S, which vary in shear resistance, discussed further below with respect to FIGS. 3, 4*a* and 4*b*. A compression layer 140 mitigates downward force and connects to an upper foot holder 142, which may take the form of a conventional athletic shoe (sneaker) or other integrated structure for engaging a foot/leg of the wearer (athlete) 144. The beams 120 occupy the perimeter of the lower plane 110 for surrounding the upper plane 130 to maintain alignment when shear force is within the control threshold. The compression layer 140 therefore defines an operator interface 141 transmitting forces exerted by the wearer/athlete, and the lower layer 110 defines a floor interface 111 transmitting forces exerted by a floor 125.

The integration of the mechanical systems into the shoe (appliance) 150 therefore include both a shear absorption system as well as a vertical absorption system. The system is placed into the shoe below the foot bed and above the tread system. This allows the shear absorption of the shoe to be close to the ground preventing ankle injuries but still allows the vertical absorption to have the required distance traveled needed to decrease the ground reaction forces.

Figure 3A:
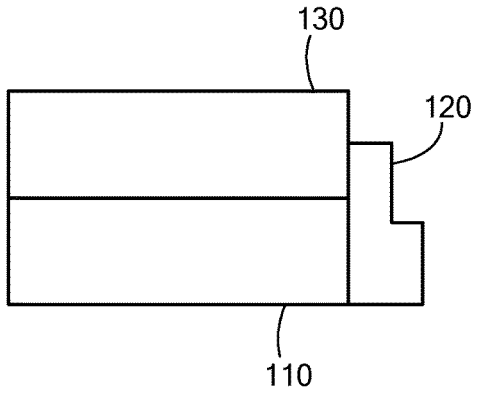
FIGS. 3*a* and 3*b* show beam deflection in the device of FIGS. 1*a*-1*c;*
Figure 3B:
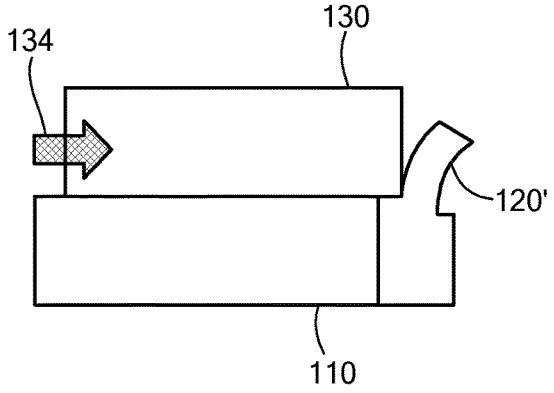

FIGS. 3*a* and 3*b* shows beam deflection in the device of FIGS. 1*a*-1*c*. Referring to FIGS. 2 and 3*a* and 3*b*, many non-contact injuries in athletes occur with the sudden deceleration of the athlete paired with a change in direction. These movements create circumstances in the knee that can cause ACL tears. These include the valgus position of the knee, which with excess forces cause the tear to occur. Preventing these tears from occurring requires a reposition of the knee, a decrease in ground reaction forces and a system that allows for greater travel in the foot when impact is made with the ground. Configurations herein provide a system that both decreases ground reaction forces as well as allows for greater travel of the foot on impact. Two shearing systems create the desired integrated appliance.

The first shearing system consists of a series of beams 120 that bend when shearing forces are applied to the shoe, embodied as the upper 130 and lower 110 layers. Based upon conflicting forces from the operator interface 141 and the floor interface 111, opposing shear forces result between the upper 130 and lower 110 layers, shown by arrow 134, and resulting in a deflected beam 120.' The deflection force of the beam 120' results from the resilient properties of the lower plane 110, which may be formed from any suitable material, such as butyl rubbers, styrene butadiene, isoprene, or natural rubber, for example. The beam 120 system may employ a double beam system with a series of shorter 120-S and longer 120-L beams. The shorter beams 120-S are more resistant to deflect, or "bend over" thus holding the system together until forces begin to reach injury level. When the forces are high enough the lower beams bend over (deflect), the forces are then applied only to the taller beams 120-L. With the forces just on the taller beams, a greater displacement occurs as well, as the beams act as a force absorption and mitigating shock out of the sudden deceleration and change in direction. FIGS. 3*a* and 3*b* show the deflection of the beams, in conjunction with the shearing layers 110, 130 applying the force to the beam based on the construction of FIG. 2.

The beams 120 therefore deflect in response to forces exerted by the upper plane 130 in response to the operator interface 141 and opposed by frictional forces exerted by the floor surface 125 and the lower plane 110. The set of beams 120 is disposed on a perimeter of the lower plane around a perimeter 112 of the upper plane 130 such that movement of the upper plane 130 is restricted by deflection (120') of the beams 120 in response to the lateral movement (force) 134. The beams 120 are adapted to oppose the lateral movement responsive to a control threshold, such that the control threshold is based on a desired resistance of the upper plane to displacement against the lower plane. A predetermined desired resistance defines an expected response of the lower plane 110 against the force exerted by the upper plane 130, and is a function of the material composition of the beams 120 and lower plane 110.

The beam design is determined through various iterations of the design as well as a series of FEA analysis completed to determine high stress concentrations on the beam and redesign to avoid such concentrations. A fillet may be added to the lower portion of the beam to lower the stress concentration in the lower half of the beam. The beam 120 may also be tapered to provide a more even bend in the beam and a delay in the shearing contact point. The taper also allows the shearing layer to bend over the beam activating the next beam in the system.

Since the floor 125 reaction forces are a high contributing factor to the tearing of an ACL in non-contact situations, it is illustrative to model the interface between the foot, shoe and ground. It can be reviewed as a non-linear spring-damper system. The following equations are used to model these interfaces.

$$F=0,\ y>0$$

$$F=Ay^b+Cy^d\ v^e,\ y\leq 0$$

$A=1.0*10^6$, $b=1.47$, $C=2.0*10^4$ $D=0.74$, $e=1.0$

Where y is the distance in meters between the foot and the ground in the global Y coordinate system and v is the velocity in m/s of the foot with respect to the ground in the global Y coordinate system. The analysis estimates that the peak value of forces on the leg equated to about 5.1 times body weight of the individual, with varying results with different hip stiffness and knee alignments.

Figure 4A:
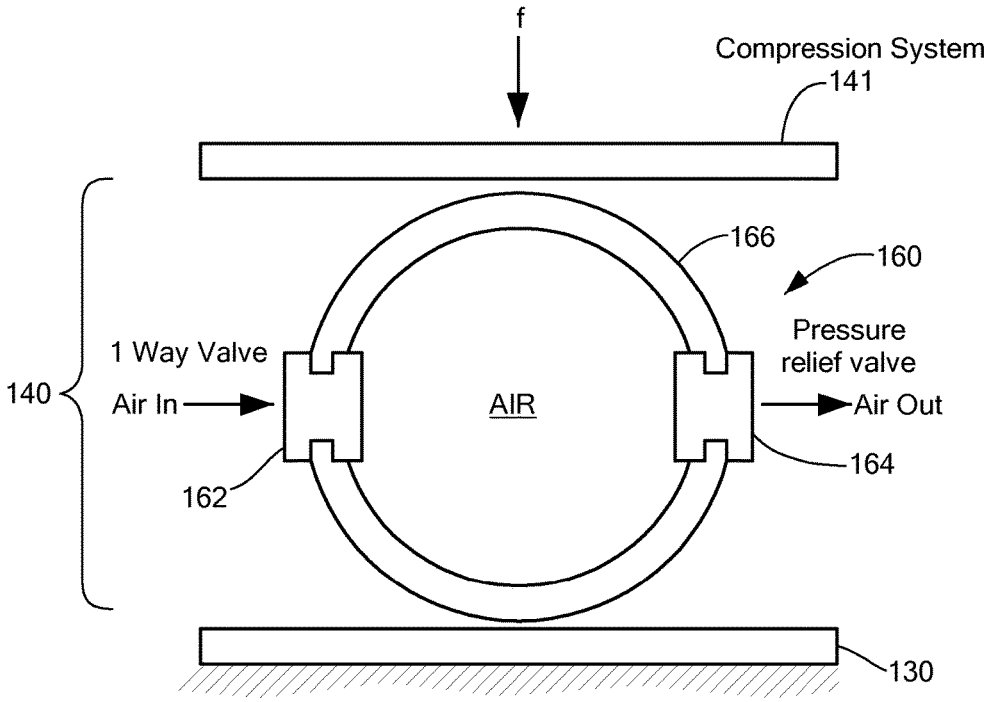
FIGS. 4*a* and 4*b* show configurations of a compression layer as in FIG. 2.
Figure 4B:
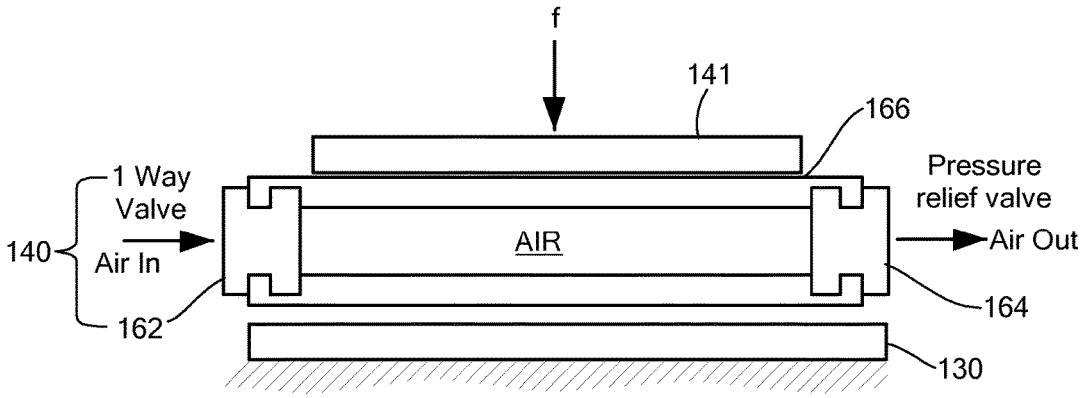

The second shearing system is directed to downward forces experienced by the compression layer 140. In the example configuration disclosed, FIGS. 4*a* and 4*b* show configurations of a compression layer as in FIG. 2. The example system is an air compression mechanism. Referring to FIGS. 2, 3 and 4*a*-4*b*, the second shearing system design incorporates an air compression system 160 into the shearing layers 110, 130, shown as a fluid chamber 166 in the compression layer 140. A particular configuration is spherically shaped and positioned under the heel where high floor 125 reaction forces are determined to occur. This spherically shaped fluid chamber 166 contains two valves in the system to contain the air and release when ground reaction forces begin to reach injury threshold level. This compression layer 140 operates similar to the beam system in that additional movement takes place when an increase in shear forces is experienced. A two valve system is established containing a one way valve 162 and a pressure relief valve 164. The first valve is a one way valve, which valve contains the air during compression, but allows air to enter during the recovery phase. Calculations to determine the required valves and material are similar to the above calculations for the compression system. The major variation in the calculations is determining the stress in the system. In a first example arrangement, the compression system is a spherical chamber which is defined by the equation:

$$\sigma_1 = \sigma_h = \frac{Pr}{2t}$$

It is also beneficial to calculate the longitudinal stress ($\sigma_1$) as well as the hoop stress ($\sigma_h$) of the system. This ensures that the stresses found in the system do not exceed the determined max stresses of the material chosen. The following equations would be used to determine such stresses in the system $$\sigma_1 = \frac{Pr}{2t}$$

$$\sigma_h = \frac{Pr}{t}$$

Average injury forces applied to system is equal to 4 to 5 times a person's body weight. Calculations are based on of a 215 pound male.

FIG. 4*b* shows an alternate configuration having a rectangular chamber 166' disposed between the layers 141 and 130. Both configurations may employ air or an alternate fluid arrangement as appropriate. In either arrangement, the fluid chamber 166, 166' prevents displacement by enclosing a fluidic volume responsive to pressure between the footwear (operator) interface 141 and the floor interface 111, and releases fluid from the fluidic volume in response to forces greater than the control threshold. The enclosure of the fluidic volume is adapted to oppose the lateral movement based on the control threshold, such that the control threshold based on a desired resistance of between the footwear interface 141 and the floor interface 111, in which the fluidic volume is adapted to escape based on an injury threshold, such that the injury threshold is defined by an excessive force of the footwear interface 141 and the floor interface 111, in which the excessive force transmits an undesirable level of force to the footwear interface 141.

Figure 5:
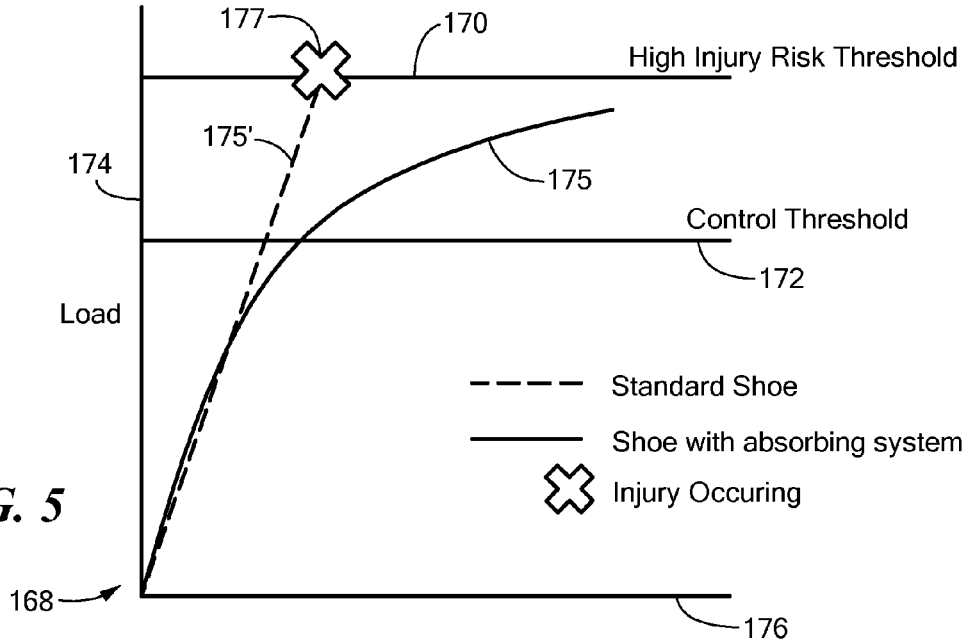
FIG. 5 shows the control and injury thresholds implemented in the configurations of FIGS. 1-5.

FIG. 5 shows the control and injury thresholds implemented in the configurations of FIGS. 1-5. Referring to FIGS. 3, 4*a*, 4*b* and 5, the beams 120 are adapted to resiliently deflect based on an injury threshold 170. A force graph 168 shows a relation between displacement force 134 on vertical axis 174, and the relative beam 120 displacement 120' on a horizontal axis 176. The injury threshold 170 is defined by an excessive force of the upper plane 130 against the lower plane 110, in which the excessive force transmits an undesirable level of force to the operator interface 141, such that the lower plane 110 returns to alignment with the upper plane 130 upon removal of the excessive force via nondestructive resilient deflection of the beams 120. A control threshold 172 defines the point at which the beams 120 begin to deflect, thus offsetting control of the lower plane 110 with injury mitigation. Continued force 134 causes progressively greater displacement to avoid injury by mitigating the force short of the injury threshold 170. The beams 120 therefore maintain deflection between the control threshold 172 and the injury threshold 170, such that the lateral movement less than the control threshold 172 is permitted and lateral movement greater than the control threshold 172 is absorbed by deflection of the beams prior to the injury threshold 170.

In the example configuration, the beams 120 deflect within a range that retains control of an operator over the lower plane 110 when the deflection force 134 is less than the control threshold 172. Thus, the control threshold 172 is intended to define when the upper plane 130 and lower plane 110 remain aligned to preserve wearer control over the appliance 150 against the floor 125. Once the force 134 reaches and exceeds the control threshold 172, the beam deflection effectively offsets control with beam deflection to mitigate injurious forces. Just prior to the injury threshold 170, the beam deflection (displacement) 176 is at a maximum to absorb the force 134 before the wearer experiences injury. The resilient nature of the beams 120 allows the beams to return to the at-rest orthogonal position and realign the upper and lower planes 110, 130 and allow the wearer to continue usage, which may allow uninterrupted competitive performance in a fast paced competition.

The construction of the lower plane 110 implements the beam 120 structure such that the beams include control beams 120-S, which are shorter and adapted to absorb forces less than the control threshold 172. The beams 120 also include longer limiting beams 120-L adapted to absorb forces greater than that which deflect the control beams and less than the control threshold, such that the limiting beams 120-L are further configured to deflect at force greater than the control threshold 172, also as discussed above. The shorter control beams 120-S provide greater force against shear, as shown by the steeper slope of the force curve 175 below the control threshold 172. Once the control threshold 172 is reached, the shorter beams 120-S may be fully deflected, allowing the limiting beams 120-L to absorb the remaining force, as shown by the leveling off of the force curve 175. The limiting beams 120-L are intended to absorb sufficient force such that the force transmitted to the operator interface 141 (i.e. athlete's foot/leg/ACL structure) do not reach the injury point 177, shown by injury curve 175' of a conventional court shoe.

In the example configuration, the beams 120 may also include direction beams 120-D for focusing the force, such that the direction beams 120-D (FIG. 6, below) having substantially higher deflection resistance than the limiting beams for directing displacement toward the limiting beams 120-L. The direction beams 120 may take the form of a continuous ridge on the inside of the wearer's foot, opposed to the other foot. Since injurious forces are unlikely to be directed inward, the direction beams 120 stabilize the appliance 150 and direct the force mitigation to forces 134 directed outward.

Figure 6:
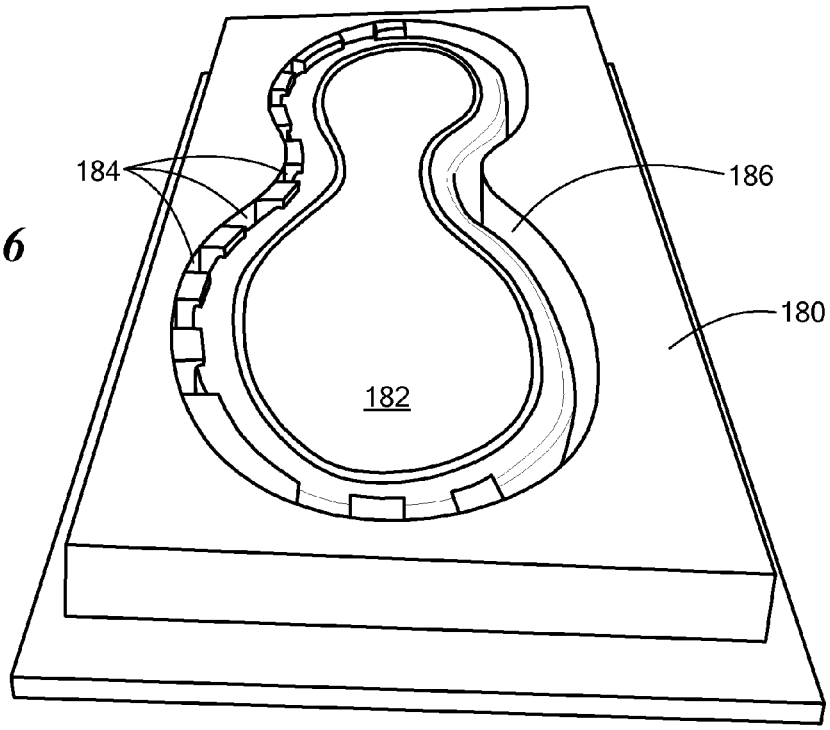
FIG. 6 is an apparatus for making the device of FIGS. 1*a*-1*c;*

FIG. 6 is an apparatus for making the device of FIGS. 1*a*-1*c*. Referring to FIG. 6, a mold 180 includes a shoe sole form 182. The shoe sole form 182 is intended to approximate the size of the wearer's shoe for integration as an appliance 150 integrated with the shoe. Recessions 184 around the perimeter of the mold define the beams 120 for the control 120-S and limiting 120-L beams, and continuous channels 186 define the direction beams 120-D.

Figure 7:
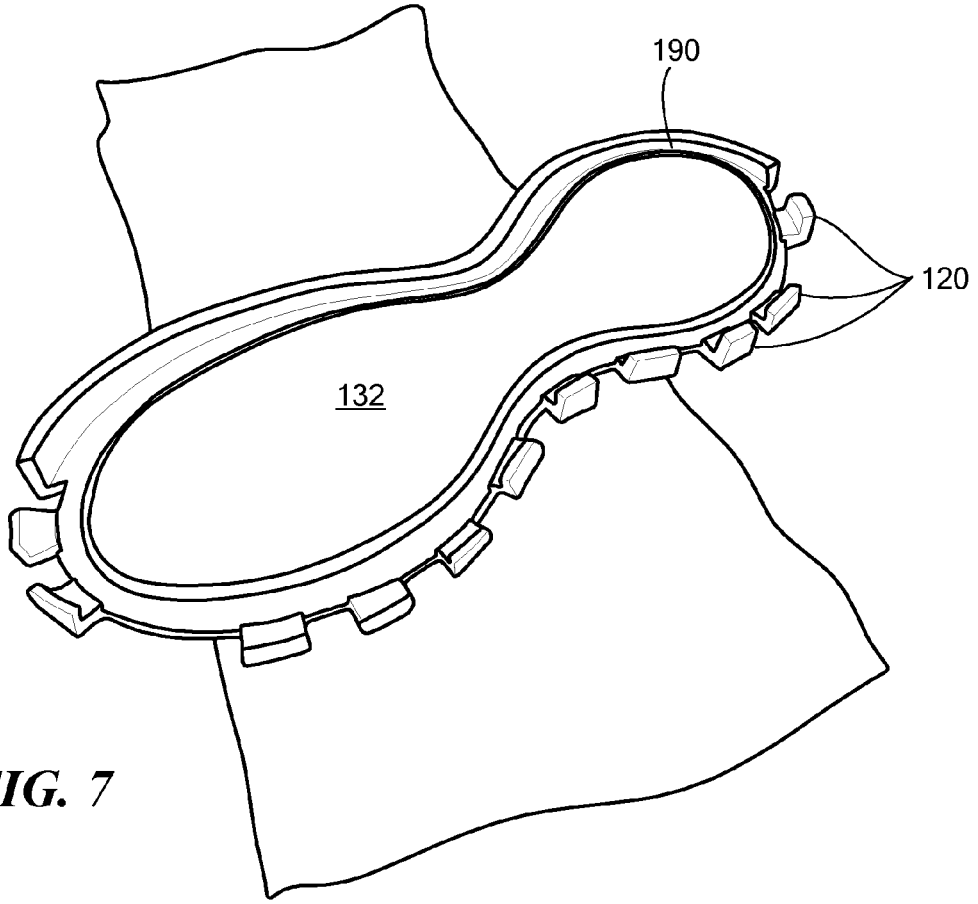
FIG. 7 shows components of FIGS. 1*a*-1*c* in the appliance of FIG. 2.

FIG. 7 shows components of FIGS. 1*a*-1*c* in the appliance of FIG. 2. Referring to FIGS. 1*a*-1*c*, 2, 6 and 7, a molding 190 cast from the mold 180 of FIG. 7 is shown. The recessions 184 in FIG. 7 define the beams 120 formed in the molding 190. The molding 190 comprises the lower layer 110, and is shown with a friction relieving layer 132 for moderating the shear force 134 between the upper layer 130 and lower layer 110.

Figure 8:
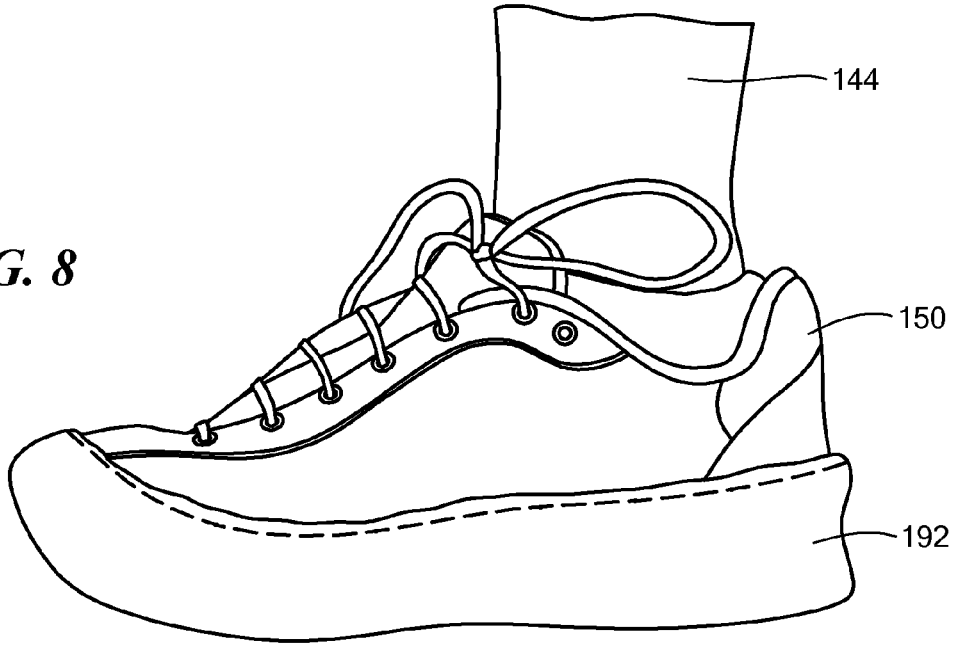
FIG. 8 shows the footwear appliance of FIG. 2 in a deployed state.

FIG. 8 shows the footwear appliance of FIG. 2 in a deployed state. Referring to FIGS. 1*a*-1*c*, 7 and 8, the appliance 150 takes the form of athletic footwear adapted to fit a wearer/athlete's foot and leg 144. The lower layer 110, upper layer 130, compression layer 140 and other constituent components are shown wrapped with a recovery linkage such as a flexible skirt 192 which maintains the layers 110, 130, 140 in communication and facilitates recovery to allow the layers 110, 130 to be drawn back into alignment following deployment. Alternatively, either the compression 140 or the upper/lower 130/110 layers may be employed separately, for selective mitigation of either vertical or lateral shear forces.

The operational appliance 150, therefore includes a recovery linkage, such that the recovery linkage restores alignment of the upper plane 130 and the lower plane 110 upon cessation of the forces 134 exceeding the control threshold 172. In the configuration shown, the recovery linkage further comprises a resilient skirt 192 around the upper 130 and lower 110 planes, such that the resilient skirt maintains the slidable communication and biasing of the upper 130 and lower 110 planes into alignment.

Configurations disclosed herein may also include features such as a sensor configured to measure the displacement force for determining a relative comparison of the displacement force to the control threshold 172 or the injury threshold 170. Such a measurement could be reviewed following a usage period to determine how close the wearer was to invoking the deflection response, for example to identify if a player is consistently playing "on the edge." The sensor may be integrated with a counter for determining a number of times the displacement force exceeds a predetermined percentage of the control threshold. A sensor such as a piezoelectric sensor could be included to respond to a deflection distance and to identify a voltage corresponding to the displacement of the beams for identifying a maximum displacement from a series of displacements.

Several conventional designs have been proposed which address shoe sole materials and patterns for mitigating force, and breakaway designs which disengage completely, thus mitigating injury but also disabling the device pending a reset or reengagement operation.

Current applications of shoe redesign to prevent ACL tears consist of patents that contain fully releasable athletic shoes include the following. U.S. Pat. No. No. 7,254,905 (to Dennison) details a system that releases when a predetermined, longitudinally directed force is applied. The technique used to accomplish this is to have a fully detachable lower sole with a mechanical release mechanism that is designed to release when a predetermined force is applied. In this application the shoe has a longitudinal guiding element, allowing for release only do to longitudinal forces. The claims state the longitudinal direction of release prevents knee ligament injuries including ACL injuries. U.S. Pat. No. 3,668,792 titled Breakaway Athletic Safety Shoe issued to York in 1971 creates and discusses a breakaway system that removes the lower sole of the shoe leaving only an upper section of the sole still attached. The lower portion can include cleats or just a normal shoe tread. The system is spring loaded and completely releases with activation. Another type of releasable sole is detailed in U.S. Pat. No. 5,456,027, issued to Tecchio et al. This design utilizes an electronic breakaway system, which measures forces in the shoe with internal strain gauges. The electronic system must be pre-set before use, based on the athlete's body type and demands on the shoe during its use. If exceedingly high forces are experienced in the strain gauges, then the entire sole is automatically detached from the rest of the sole, avoiding injury. The sole could then be reattached to resume play.

There are also several designs that aim at reducing friction to allow rotation of the foot to avoid injury. U.S. Pat. No. 5,867,923 to Lehneis is an orthotic shoe with torsion sole. This shoe has an insole and an outsole that are placed together in the center on a pivot. The pivot allows relative rotation along the plane parallel to the shoe sole. U.S. Pat. No. 4,670,997 issued to Beekman titled Athletic Shoe Sole reviews the various tread patterns associated with injury of athletes. With this review they re-designed the tread to reduce friction on surfaces as well as allow more rotation at the ball of the foot in the shoe with decreased friction. The use of flexible fabric is used to provide greater rotation as well as a decrease in friction when the user pivots in the shoe. U.S. Pat. No. 4,546,556 titled Basketball Shoe Sole issued to Stubblefield designs the sole of an athletic shoe to be used on hard surfaces such as a basketball court. The design of the sole allows for the absorption of more forces in the shear direction as well as a sole pattern design that allows for easier pivot rotation of the foot. U.S. Pat. No. 3,707,047, entitled Swivel Athletic Shoe, claims that the shoe contains a pivot portion of the shoe located at the ball of the foot. This pivot point allows for easier rotation of foot on high friction surfaces, thus decreasing injury in athletes. Another method of shoe redesign to absorb large possible injurious loads is U.S. Pat. No. 5,255,453 to Weiss. In this shoe design the cleat has a means of breaking away with adhesive layer on the top portion of each cleat. The cleats and the adhesive layer have a predetermined failure shear force which causes the shoe to decompose and break apart absorbing the load and reducing the occurrence of injury.

None of the proposed prior art approaches teaches a beam system for selectively controlling shear forces within a control threshold via a system of deflecting beams moderating slidable communication between planar surfaces, and nondestructively releasing upon exceeding the control threshold but prior to an injury threshold, such that the wearer (athlete) is not injured and the appliance returns to a former rest (undisplaced) state to resume usage.

Configurations herein are amenable to multiple areas of commercial use including use by athletes, laborers and military purposes. The invention itself would benefit all who are at any risk for ACL injury. Anyone participating in any physical motion that requires a sudden de-acceleration and change in direction is at risk for an ACL injury. Our major target audience for the product is athletes participating in sports that require a considerable amount of jumping and changing of directions. The invention can be applied to athlete's shoes allowing them to eliminate the worries of injuring the ACL associated with shear and compression forces.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A footwear interface device comprising: a lower plane defining a frictional interface to a floor surface; a plurality of beams disposed on the lower plane and defining a set of beams extending substantially orthogonal to the lower plane, the set of beams including limiting beams and control beams, the control beams having a first height and the limiting beams having a second height, the first height based on a control threshold and the second height being greater than the first height and based on an injury threshold defined by a force greater than the control threshold; an upper plane slideably engaging the lower plane, the upper plane aligned with the lower plane for restricted movement based on the beams, the upper plane defining an interface to an operator; the beams configured to slideably engage the upper plane and deflect in response to a lateral movement of the upper plane relative to the lower plane, the limiting beams and control beams adapted to selectively exert force in response to a force of the lateral movement; and the set of beams adapted to deflect in response to forces exerted by the upper plane in response to the operator interface and opposed by frictional forces extended by the floor surface and the lower plane, and to subsequently return the upper plane to alignment with the lower plane in response to the lateral movement.

2. The device of claim 1 wherein the set of beams is disposed on a perimeter of the lower plane around a perimeter of the upper plane such that movement of the upper plane is restricted by deflection of the beams in response to the lateral movement.

3. The device of claim 1 wherein the beams in the set of beams are adapted to oppose the lateral movement responsive to a control threshold, the control threshold indicative of intended, non-injurious movement based on a resistance of the upper plane to displacement against the lower plane, the desired resistance defining expected response of the lower plane against the force exerted by the upper plane.

4. The device of claim 3 wherein the beams in the set of beams are adapted to resiliently deflect based on an injury threshold indicative of a force at which injury occurs, the injury threshold defined by an excessive force of the upper plane against the lower plane, the excessive force transmitting an undesirable level of force to the operator interface, the lower plane returning to alignment with the upper plane, upon removal of the excessive force, via nondestructive resilient deflection of the beams.

5. The device of claim 4 wherein the beams in the set of beams maintain deflection between the control threshold and the injury threshold, such that the lateral movement less than the control threshold is permitted and lateral movement greater than the control threshold is absorbed by deflection of the beams prior to the injury threshold.

6. The device of claim 4 wherein the beams in the set of beams deflect within a range that retains control of an operator over the lower plane when the deflection force is less than the control threshold.

7. The device of claim 1 wherein the beams in the set of beams include control beams adapted to absorb forces less than the control threshold.

8. The device of claim 7 wherein the beams in the set of beams include limiting beams adapted to absorb forces greater than that which deflect the control beams and less than the control threshold, the limiting beams further configured to deflect at force greater than the control threshold.

9. The device of claim 7 wherein the beams in the set of beams further comprises direction beams for increasing a force for deflection, the direction beams having substantially higher deflection resistance than the limiting beams for directing displacement toward the limiting beams.

10. The device of claim 1 further comprising a sensor configured to measure the displacement force for determining a relative comparison of the displacement force to the control threshold or the injury threshold.

11. The device of claim 10 further comprising a counter for determining a number of times the displacement force exceeds a predetermined percentage of the control threshold.

12. The device of claim 10 wherein the sensor is a piezoelectric sensor for identifying a voltage corresponding to the displacement of the beams for identifying a maximum displacement from a series of displacements.

13. The device of claim 1 further comprising a recovery linkage, the recovery linkage restoring alignment of the upper plane and the lower plane upon cessation of the forces exceeding the control threshold.

14. The device of claim 13 wherein the recovery linkage further comprises a resilient skirt around the upper and lower planes, the resilient skirt maintaining the slidable communication and biasing the upper and lower planes into alignment.

15. The device of claim 1 wherein the set of beams is responsive to direct force of the upper plane resulting from a shear force of the upper plane relative to the lower plane.

16. The device of claim 15 wherein the set of beams define a shear resistance between the lower and upper planes, the shear resistance based on a control threshold and an injury threshold, the shear resistance increasing when the control threshold is attained, and the shear resistance decreasing in resistance when an injury threshold is attained.

17. A footwear appliance for mitigating injurious lateral forces comprising: a plurality of beams arranged around a perimeter of a lower plane defining a frictional interface to a floor surface, the beams extending substantially orthogonal to the lower plane, the plurality of beams including limiting beams and the control beams, the control beams having a first height and the limiting beams having a second height, the first height based on a control threshold and the second height being greater than the first height and based on an injury threshold defined by a force greater than the control threshold; an upper plane retained by the beams in slideable communication with the lower plane, the beams engaging the upper plane for limiting movement in response to lateral forces between the upper and lower planes, the lateral forces resulting from friction with the floor surface and opposing forces from the upper plane; and the set of beams adapted to deflect in response to forces exerted by the upper plane in response to the operator interface and opposed frictional forces exerted by the floor surface and the lower plane and configured to deflect in response to the lateral forces and subsequently return the upper plane to alignment between the undeflected beams, the limiting beams and control beams adapted to selectively exert force in response to the lateral force.

18. The appliance of claim 17 wherein the beams are adapted to oppose the lateral movement responsive to a control threshold, the control threshold based on a resistance of the upper plane to displacement against the lower plane, the desired resistance defining expected response of the lower plane against the force exerted by the upper plane.

19. The appliance of claim 18 wherein the beams are adapted to deflect based on an injury threshold indicative of a force at which injury occurs, the injury threshold defined by an excessive force of the upper plane against the lower plane, the excessive force transmitting an undesirable level of force to the operator interface.

20. An athletic shoe comprising: a lower component with two planar surfaces and an upper component with one coplanar surface sliding on an upper plane of the lower component, the coplanar surface, upper plane and a lower plane of the lower component arranged vertically beneath the shoe; the lower plane of the lower component defining a frictional interface to a floor surface; a plurality of beams disposed on at least one of the two planar surfaces and defining a set of beams extending substantially orthogonal to the lower plane, the set of beams including limiting beams and control beams, the control beams having a first height and the limiting beams having a second height, the first height based on a control threshold and the second height being greater than the first height and based on an injury threshold defined by a force greater than the control threshold; the upper plane slideably engaging the lower plane, the upper plane aligned with the lower plane for restricted movement based on the beams, the upper plane defining an interface to an operator via the coplanar surface; the beams configured to slideably engage the upper plane and deflect in response to lateral movement of the upper plane relative to the lower plane; and the beams adapted to subsequently return the upper plane to alignment with the lower plane in response to the lateral movement, the limiting beams and control beams adapted to selectively exert force in response to a force of the lateral movement.

* * * * *